United States Patent [19]

Stenz

[11] Patent Number: 4,773,371

[45] Date of Patent: Sep. 27, 1988

[54] OVERRIDE SPEED CONTROL HAVING GOVERNED IDLE

[75] Inventor: Kenneth J. Stenz, Mt. Calvary, Wis.

[73] Assignee: Tecumseh Products Company, Tecumseh, Mich.

[21] Appl. No.: 116,395

[22] Filed: Nov. 3, 1987

[51] Int. Cl.[4] ..... E02D 31/00

[52] U.S. Cl. ..... 123/376; 123/400

[58] Field of Search ..... 123/376, 400

[56] References Cited

U.S. PATENT DOCUMENTS

| | | | |
|---|---|---|---|
| 2,338,912 | 1/1944 | Ericson | 123/376 |
| 2,837,070 | 6/1958 | Agar | 123/376 X |
| 2,908,263 | 10/1959 | Brown | 123/395 |
| 3,014,377 | 12/1961 | Anderson | 74/97 |
| 3,194,224 | 7/1965 | Lechtenberg | 261/34.1 |
| 3,276,439 | 10/1966 | Reichenbach | 123/376 |
| 3,305,223 | 2/1967 | Reichenbach | 261/52 |
| 3,749,069 | 7/1973 | Reese | 123/376 |
| 4,079,708 | 3/1978 | Wieland et al. | 123/376 |
| 4,462,268 | 7/1984 | Boeger | 74/519 |
| 4,476,068 | 10/1984 | Griffin et al. | 261/65 |
| 4,490,309 | 12/1984 | Fujikawa et al. | 261/52 |
| 4,517,942 | 5/1985 | Pirkey | 123/376 |
| 4,631,153 | 12/1986 | Tamba et al. | 261/52 |

*Primary Examiner*—Tony M. Argenbright
*Assistant Examiner*—Eric R. Carlberg
*Attorney, Agent, or Firm*—Albert L. Jeffers

[57] ABSTRACT

An override speed control mechanism for an internal combustion engine. The override speed control mechanism comprises an engine control lever connected to a governor control arm by means of an over-center linkage mechanism so that further rotation of the engine control lever beyond the high speed range into the choke range acts to reduce tension on the governor spring. The mechanism also includes a governed idle whereby the position of the governor control arm can be adjusted in the idle position to set the tension on the governor spring.

17 Claims, 3 Drawing Sheets

OVERRIDE SPEED CONTROL HAVING GOVERNED IDLE

BACKGROUND OF THE INVENTION

The present invention relates to carburetor control systems for internal combustion engines and in particular to override speed control systems for small internal combustion engines such as those used with lawnmowers and other lawn and garden implements.

It is desirable that the speed of internal combustion engines be controlled so that the speed of the engine remains relatively constant under different loading conditions. For instance, in the use of a lawnmower which is powered by an internal combustion engine, it is desirable that the selected speed of the engine remain relatively constant despite various loading conditions. Thus, as the lawnmower encounters tall grass which loads the engine down or relatively short grass under which condition the engine has relatively low loading, the lawnmower speed which has been selected by the operator should remain substantially constant.

In the conventional design of small internal combustion engines, speed controls have been provided which control the carburetor to provide constant engine speed for different loading conditions. Such carburetors are normally provided with a choke valve and a throttle valve and have a governor connected with the speed control lever and the throttle and choke valves for maintaining constant speed. The governor conventionally comprises a pair of rotating flyweights which is rotated by the engine and has an output shaft or lever which is connected with the speed control lever and a throttle valve to maintain constant engine speed.

The speed control lever commonly consists of two parts, one of which is connected by means of a control cable to a manually operable control lever and the other of which is connected to the governor lever. The two parts cooperate to control the choke and throttle valves and are generally interconnected with an adjustment screw by which the high speed setting of the engine is adjusted. The control lever has an idle position, a start-/run position and a choke position. The control lever is connected to the choke valve so that in the choke position the air flow to the engine is reduced and a rich fuel mixture is admitted to the engine.

By means of such type of controls, the speed of the engine will remain relatively constant for any of the settings of the control lever because of the interaction of the governor with the throttle valve and the control lever.

A particular prior art override speed control is disclosed in U.S. Pat. No. 4,517,942, which patent is expressly incorporated herein by reference. The override speed control disclosed in said patent comprises a speed control lever, an intermediate lever and a throttle control lever. The three levers are interconnected by means of extension springs, one each of which connects the intermediate lever respectively to the speed control lever and the governor lever. The speed control lever in the last increment of movement of its control range actuates the choke valve of the carburetor and the governor lever controls the throttle valve of the carburetor. A governor driven by the engine and responsive to engine speed is connected to the governor lever and adjustable stop means are provided on the intermediate lever to positively stop the movement of the intermediate lever during the last increment of movement of the speed control lever. During this last increment of movement of the control lever, the intermediate lever is unresponsive to the movement of the speed control lever, and the speed of the engine will be maintained at the high speed setting during movement of the speed control lever into the choke range.

A problem with certain prior override speed controls is that when the control lever is moved from the high speed range into the choke range, the tension increases on the control cable. This results in higher operating forces and gives the operator the feel of a stiffer control when moving into the choke range.

SUMMARY OF THE INVENTION

The override speed control according to the present invention incorporates into a single control mechanism an override speed control function and a governed idle system. In a preferred form of the invention, there is provided an over-center mechanism whereby, when the engine control lever is moved into the choke position, the tension on the governor spring decreases. This results in lower force on the engine control lever which permits the operator to move the control lever into the choke position with greater ease. By reducing the operating forces on the control linkage, there is less stress on the control and longevity thereof will be improved.

Governed idle is controlled by an adjustment screw connected to the governor adjust arm and positioned such that it abuts a portion of the engine housing in the idle position. A slotted arrangement between the governor adjust arm and the rigid control link with the engine control lever provides limited isolation so that the control link does not interfere with the govered idle setting. A further feature in the preferred embodiment of the invention includes a governor adjust arm which has a bendable portion so that the high speed level can be factory set by moving the control lever into the high speed position and then bending the governor adjust arm to tension on the governor spring until the desired high speed is achieved.

The present invention, in one form thereof, relates to an override speed control mechanism for an internal combustion engine having a carburetor with a throttle valve and a choke valve and a governor mounted on the engine and driven thereby, the governor including a control arm that is operatively connected to the throttle valve for adjusting the throttle valve in accordance with engine speed. A moveable engine control lever is manually operable to select engine speed, the lever being positionable sequentially through a low speed, high speed and choke range. A moveable governor adjust arm is yieldably connected to the governor control arm by a spring and a choke control arm is connected to the choke valve. A mechanism is interposed between the engine control lever and the choke control arm for moving the choke arm into the choke position when the engine control lever is positioned in the choke range. A control link member is connected between the engine control lever and the governor adjust arm for moving the governor adjust arm to change the tension of the resilient linkage as the engine control lever is moved to thereby change the setting of the throttle valve. The control link includes a tension reducing means, such as an over-center device, for causing the governor adjust arm to either reduce or maintain equal the tension of the resilient linkage as the engine control lever is moved from the high speed range into the choke range. An idle adjustment mechanism associated with the governor adjust arm is operable when the engine control lever is in the low speed range to limit the movement of the governor adjust arm in a direction that reduces tension of the spring. The control link includes a lost motion mechanism for isolating the movement of the engine control lever from the governor adjust arm in the low speed range.

DETAILED DESCRIPTION OF A PREFERRED EMBODIMENT

Figures 1, 4:
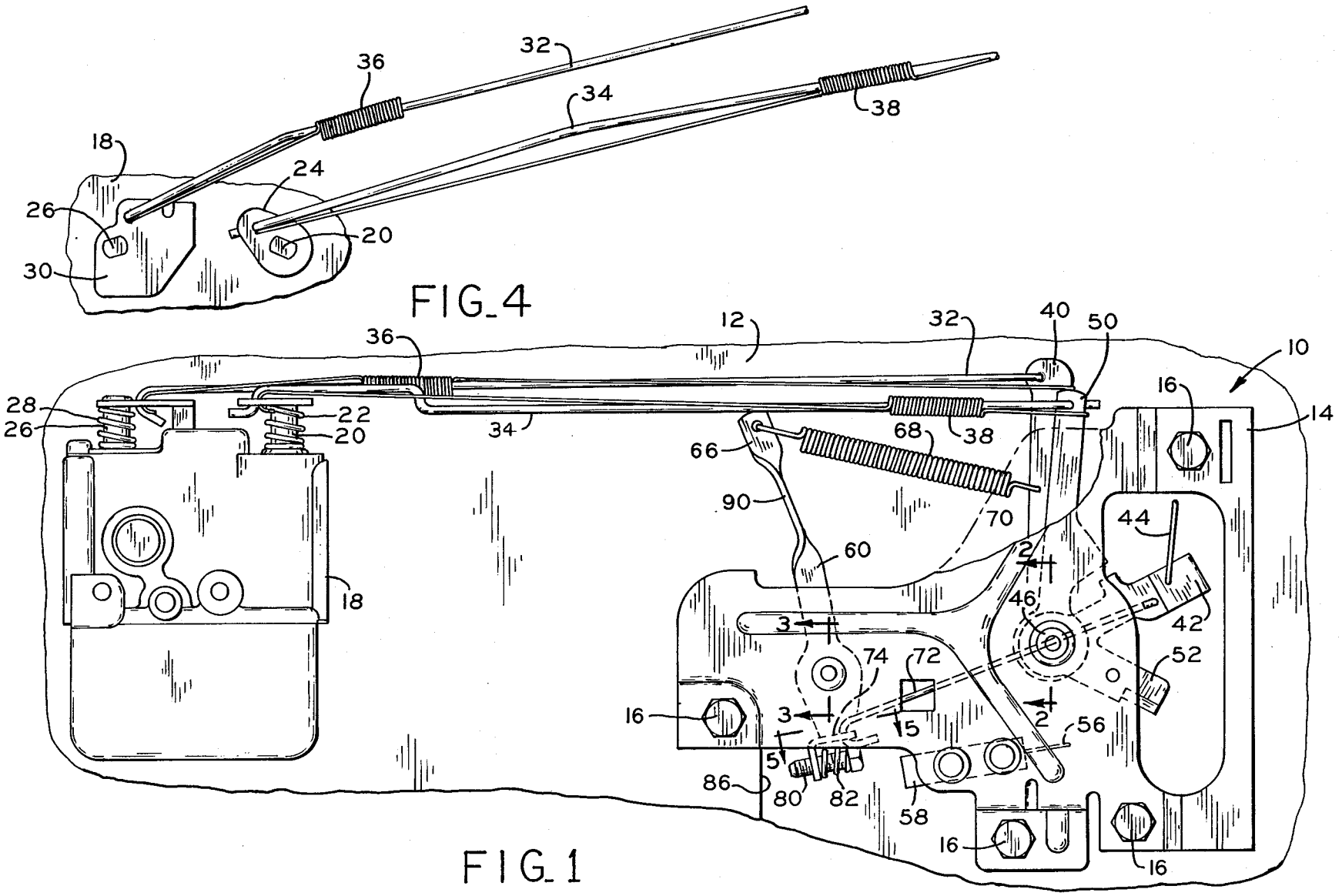
FIG. 1 is an elevational view showing the override speed control mechanism of the present invention mounted on an internal combustion engine.
FIG. 4 is a fragmentary top view showing the throttle and choke links.

Referring now to the drawings, and in particular FIG. 1, the override speed control mechanism 10 is mounted to the side of the crankcase 12 of an internal combustion engine by means of a bracket 14 connected to engine 12 by screws 16. Carburetor 18 is also mounted to engine 12 and includes a choke valve having a shaft 20 extending upwardly out of the body of carburetor 18 and being provided with a coil spring 22 that tends to rotate shaft 20 and choke lever 24 (FIG. 4) in the clockwise direction. Carburetor 18 includes a throttle valve having a shaft 26 extending upwardly therefrom out of the body of carburetor 18 that is provided with a coil spring 28 biased to rotate valve shaft 26 and throttle lever 30 (FIG. 4) in the clockwise direction. The rotation of levers 24 and 30 in the clockwise direction pushes throttle link 32 and choke link 34 to the right as viewed in FIGS. 1 and 4. Links 32 and 34 are provided with springs 36 and 38, respectively, which aid in reducing rattling of the control linkage.

Governor control arm 40 is pivotably connected to engine 12 and is connected to a conventional governor mechanism located within engine 12, as shown in greater detail in U.S. Pat. No. 4,517,942, which is incorporated herein by reference. Governor control arm 40 is connected to throttle link 32 so that the movement of governor control arm 40 causes corresponding movement of throttle valve 26 to increase or decrease the speed of engine 12.

Figure 2:
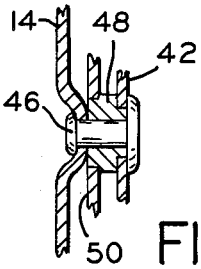
FIG. 2 is a sectional view taken along line 2—2 FIG. 1 and viewed in the direction of the arrows.
Figure 6:
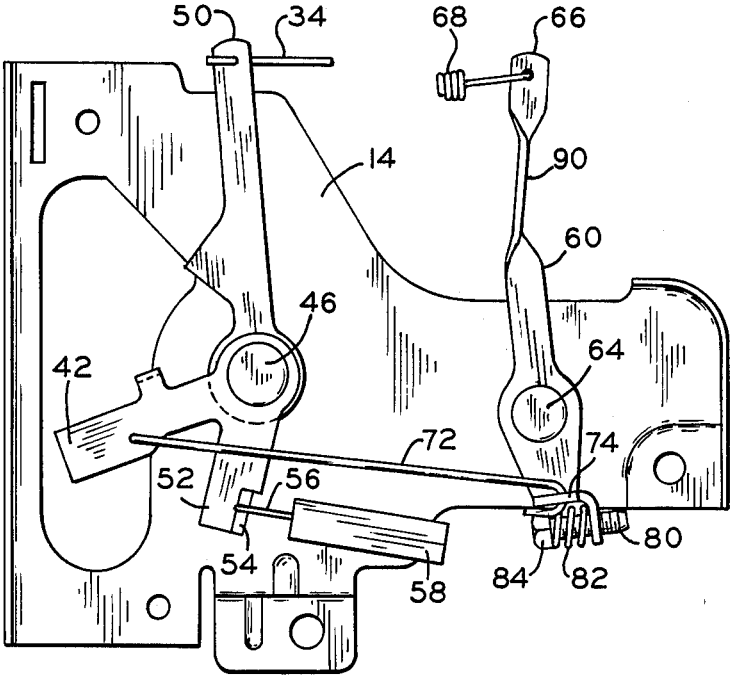
FIG. 6 is a fragmentary, elevational view of the control mechanism viewed outwardly from the engine and showing the reverse side of the control mechanism, wherein the control mechanism is in the stop position.

With reference to FIGS. 1, 2 and 6, engine control lever 42 is connected by means of Bowden cable 44 to the implement control lever (not shown), which is typically mounted on the handles of the lawnmower or other device in a position where it can be conveniently moved by the operator. Control lever 42 is pivotally connected to bracket 14 by means of rivet 46 and bushing 48, and choke control arm 50 is similarly pivotally mounted on bushing 48. Arms 42 and 50 are independently rotatable with respect to each other. Choke control arm 50 is connected to choke link 34, the latter being connected to choke valve 20 as shown in FIG. 4.

Figure 3:
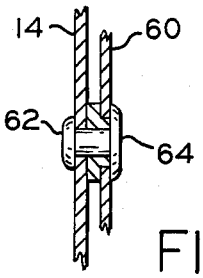
FIG. 3 is a sectional view taken along line 3—3 of FIG. 1 and viewed in the direction of the arrows.
Figure 5:
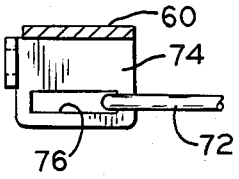
FIG. 5 is a sectional view taken along line 5—5 of FIG. 1 and viewed in the direction of the arrows.

Engine control lever 42 includes an arm portion 52 having a tab 54 that is positioned to contact the switch arm 56 of engine kill switch 58. FIG. 6 illustrates engine control lever 42 in the engine stop position wherein switch 58 is activated. Governor adjust arm 60 is pivotally connected to bracket 14 by means of rivet 62 and bushing 64, as shown in detail in FIG. 3. The upper end 66 of governor adjust arm 60 is connected to lever arm 40 by a resilient link, such as spring 68, the other end 70 of which is connected to governor control arm 40 (FIG. 1). A rigid link 72 connects engine control lever 42 to a bent over tab portion 74 (FIG. 5) on the lower end of governor adjust arm 60. As shown in FIG. 5, link 72 is received within a slot 76 of governor adjust arm 60, which provides a certain range of independent movement between arm 60 and link 72 when the mechanism is in the idle position shown in FIG. 6. An adjusting screw 80 is threadedly connected to the tab portion 74 of governor adjust arm 60 and is provided with a coil spring 82 disposed between tab 74 and the head 84 of screw 80. Adjusting screw 80 abuts a surface 86 on the side wall of engine 12 to limit the rotation of arm 60 in the idle position (FIG. 1).

It will be noted that governor adjust arm 60 includes a portion 90 that is oriented at right angles to the upper and lower portions thereof. This enables portion 90 to be bent in a direction within the plane of movement of arm 60 so that the high speed setting can be adjusted at the factory. This is accomplished by moving the engine control lever 42 to the high speed position, holding it in this position, and then bending the adjustment portion 90 of lever 60 until the desired engine speed is achieved.

With reference now to FIGS. 6–9, the operation of the override speed control mechanism 10 will be described. FIG. 6 illustrates the mechanism in the engine stop position wherein engine control lever 42 has been moved by the Bowden cable 44 to the extreme counterclockwise direction. In this position, tab 54 of arm portion 52 engages the control arm 56 of engine kill switch 58, which disables the engine ignition system in a manner well known in the art. Control link 72 rotates governor adjust arm 60 in the counterclockwise direction thereby relaxing the tension on governor spring 68 and closing throttle valve 26.

Figure 7:
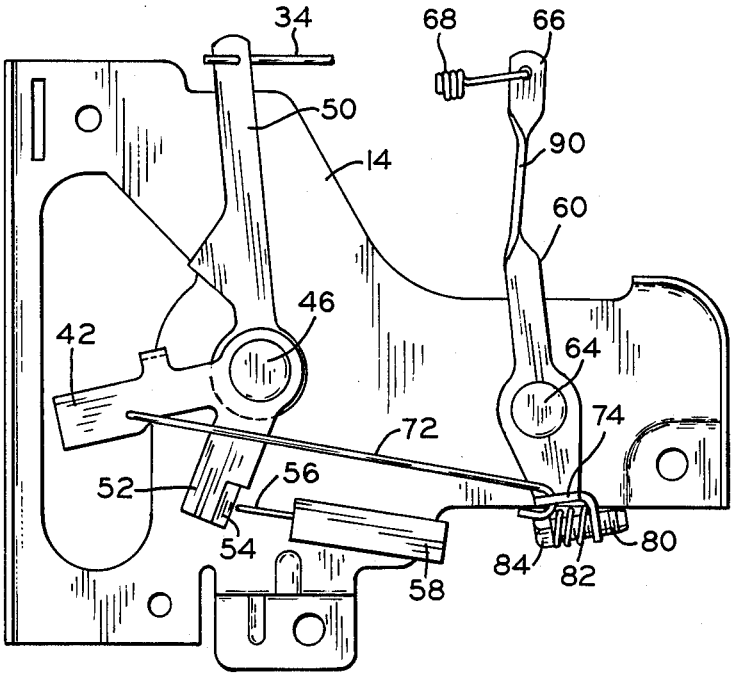
FIG. 7 is a view similar to FIG. 6 wherein the control mechanism is in the low speed position.

FIG. 7 illustrates the mechanism in the idle position wherein engine control lever 42 has been rotated slightly clockwise to disengage the arm 56 of engine kill switch 58. Arm 60 is in the idle position as controlled by the setting of screw 80. Because link 72 is received within slot 76 (FIG. 5), there is lost motion between engine control lever 42 and governor adjust arm 60 in the idle position so that the position of lever 42 does not interfere with the idle setting of arm 60. The speed of the engine is governed in the idle position because of the action of spring 68 connecting arm 60 with governor control arm 40 (FIG. 1).

Figure 8:
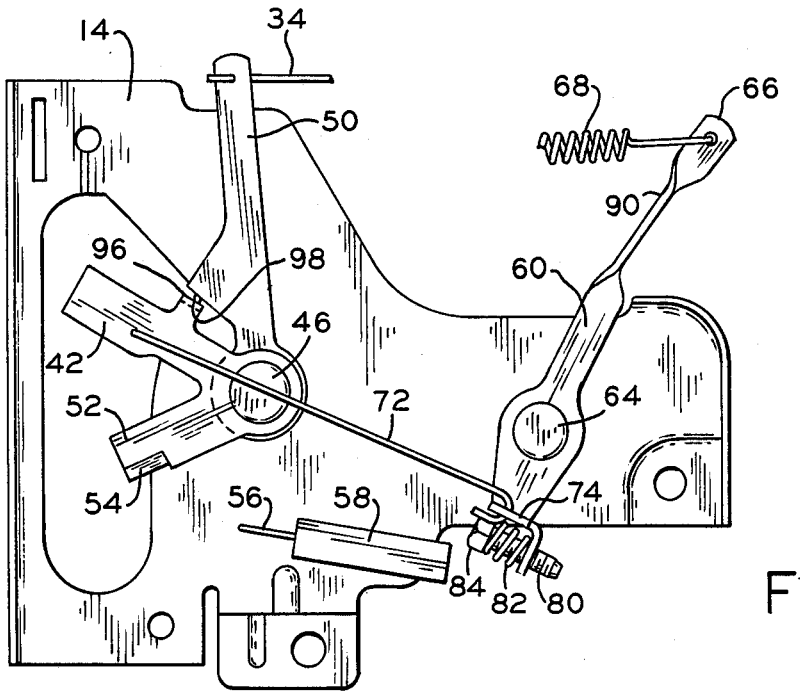
FIG. 8 is a view similar to FIGS. 6 and 7 wherein the control mechanism is in the high speed position.

In FIG. 8, engine control lever 42 has been rotated in the clockwise direction to the high speed range as result of increased tension on Bowden cable 44. Control link 72 rotates governor adjust arm 60 in the counterclockwise direction thereby increasing the tension on spring 68, which exerts a greater force on governor arm 40 thereby causing the engine to operate at a higher speed. As the speed of the engine increases, the counteracting force produced by the rotating flyweights tends to rotate governor 60 in the clockwise direction as viewed in FIG. 1, thereby rotating throttle valve 26 to a more closed position. Naturally, this results in a reduction in the speed of the engine. It will be noted that engine control lever 42 is independent of choke control lever 50 during its movement through the stop, idle and high speed ranges because levers 42 and 50 are independently mounted on pivot 46. It will also be noted that at the upper limit of the high speed range, the control link 72 is at about the center of the pivot axis defined by rivet 46, so that further rotation of lever 42 in a clockwise direction will not result in further rotation of governor adjust arm 60 in the clockwise direction.

Figure 9:
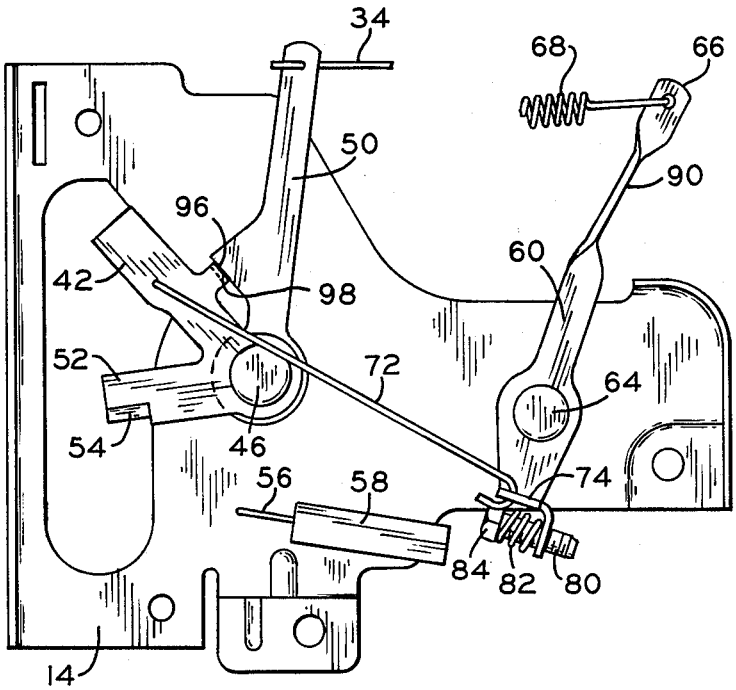
FIG. 9 is a view similar to FIGS. 6–8 wherein the control mechanism is in the choke position.

FIG. 9 illustrates the mechanism in the choke range where engine control lever 42 has been rotated past the over-center position, whereby the over-center linkage mechanism comprising arm 42, link 72 and pivot 46 acts to release tension on governor adjust arm 60, thereby permitting it to rotate counterclockwise under the action of spring 68. At the same time, an upstanding tab portion 96 on arm 42 engages the edge 98 of choke control lever 50, thereby rotating choke control lever 50 in the counterclockwise direction. This pushes choke link 34, thereby rotating choke lever 24 in the counterclockwise direction against the action of spring 22. Thus, in the choke range, the action of spring 68 is isolated from engine control lever 42, which results in a reduction in force on the Bowden cable 44 that is connected to the operator's control. When control lever 42 is rotated counterclockwise out of the choke range to the position shown in FIG. 8, governor adjust arm 60 will initially be rotated clockwise until link 72 passes over the pivot axis of control lever 42, at which time further rotation of lever 42 will permit governor adjust arm 60 to rotate counterclockwise under the action of spring 68.

While this invention has been described as having a preferred design, it will be understood that is is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. An override speed control mechanism for an internal combustion engine comprising:

a carburetor having a throttle valve and a choke valve, governor means mounted on said engine and driven thereby and responsive to engine speed, said governor means including a control arm operatively connected to said throttle valve for adjusting said throttle valve in accordance with engine speed, a moveable engine control lever manually operable to select engine speed, said lever being positionable sequentially through a low speed range, a high speed range and a choke range, a moveable governor adjust arm yieldably connected to said governor control arm by a resilient linkage means, a choke control arm connected to said choke valve, means interposed between said engine control lever and said choke control arm for moving said choke arm into choke position when said engine control lever is positioned in the choke range, control link means connected between said engine control lever and said governor adjust arm for moving said governor adjust arm to change the tension of said resilient linkage means as said engine control lever is moved to thereby change the setting of said throttle valve, said control link means including tension reducing means for causing said governor adjust arm to one of reduce or maintain equal the tension of said resilient linkage means as said engine control lever is moved from the high speed range into the choke range, and idle adjustment means associated with said governor adjust arm and operable when said engine control lever is in the low speed range for limiting the movement of said governor adjust arm in a direction that reduces tension of said resilient linkage means.

2. The override speed control mechanism of claim 1 wherein said tension reducing means comprises an over-center linkage means which assumes an over-center condition at about the time said engine control lever moves from the high speed range into the choke range.

3. The override speed control mechanism of claim 2 wherein said engine control lever is pivotably mounted to the engine, said over-center linkage means comprises a link member that is rotatably connected to said engine control member and is connected to said governor adjust arm, and said link member intersects the pivot axis of said engine control lever in the over-center position.

4. The override speed control mechanism of claim 3 wherein said over-center means moves the governor adjust arm to reduce tension of the resilient linkage means as said engine control lever is moved from the high speed range into the choke range.

5. The override speed control mechanism of claim 1 wherein said over-center means moves the governor adjust arm to reduce tension of the resilient linkage means as said engine control lever is moved from the high speed range into the choke range.

6. The override speed control mechanism of claim 5 wherein said resilient linkage means comprises a spring connecting said engine control lever and governor control arm.

7. The override speed control mechanism of claim 1 wherein said governor control arm rotates through a plane under the action of said engine control lever and said control link means, and said governor control arm includes an adjustment portion connected to said resilient linkage means that is bendable in said plane to enable high speed preadjustment of the tension of said resilient linkage means.

8. The override speed control mechanism of claim 1 wherein said control link means includes lost motion means for isolating the movement of said engine control lever from said governor adjust arm in the low speed range.

9. The override speed control mechanism of claim 8 wherein said lost motion means comprises a slot in one of said engine control lever and said governor adjust arm in which said control link is received.

10. The override speed control mechanism of claim 9 wherein said slot is in said governor adjust arm in proximity to said idle adjustment means.

11. The override speed control mechanism of claim 1 including an engine stop switch and means connected to said engine control lever for actuating said stop switch at a selected position of said engine control lever outside of the low speed, high speed and choke ranges.

12. An override speed control mechanism for an internal combustion engine comprising:

a carburetor having a throttle valve and a choke valve, governor means mounted on said engine and driven thereby and responsive to engine speed, said governor means including a control arm operatively connected to said throttle valve for adjusting said throttle valve in accordance with engine speed, a moveable engine control lever manually operable to select engine speed, said lever being positionable sequentially through a low speed range, a high speed range and a choke range, a moveable governor adjust arm yieldably connected to said governor control arm by a spring, a choke control arm connected to said choke valve, means interposed between said engine control lever and said choke control arm for moving said choke arm into choke position when said engine control lever is positioned in the choke range, control link means connected between said engine control lever and said governor adjust arm for moving said governor adjust arm to increase the tension of said spring as said engine control lever is moved through the high speed range toward the choke range, said control link including over-center linkage means for moving the governor adjust arm in a direction to reduce spring tension as the engine control lever is moved from the high speed range into the choke range, and idle adjustment means associated with said governor adjust arm and operable when said engine control lever is in the low speed range for limiting the movement of said governor adjust arm in a direction that reduces tension of said spring, said control link means including lost motion means for isolating the movement of said engine control lever from said governor adjust arm in the low speed range.

13. The override speed control mechanism of claim 12 wherein said over-center linkage comprises a link member that is rotatably connected to said engine control lever and is connected to said governor adjust arm, and said link member intersects the pivot axis of said engine control arm in the over-center position.

14. The override speed control mechanism of claim 12 wherein said governor control arm rotates through a plane under the action of said engine control lever and said control link means, and said governor control arm includes an adjustment portion connected to said spring that is readily bendable in said plane to enable high speed preadjustment of the tension of said spring.

15. The override speed control mechanism of claim 12 wherein said lost motion means comprises a slot in one of said engine control lever and said governor adjust arm in which said control link is received.

16. The override speed control mechanism of claim 15 wherein said slot is in said governor adjust arm in proximity to said idle adjustment means.

17. The override speed control mechanism of claim 12 including an engine stop switch and means connected to said engine control lever for actuating said stop switch at a selected position outside of the low speed, high speed and choke ranges.

* * * * *